US010467940B2

(12) United States Patent
Shin et al.

(10) Patent No.: US 10,467,940 B2
(45) Date of Patent: Nov. 5, 2019

(54) SENSING APPARATUS, DISPLAY APPARATUS, AND METHOD OF SENSING ELECTRICAL SIGNAL

(71) Applicant: SAMSUNG DISPLAY CO., LTD., Yongin, Gyeonggi-Do (KR)

(72) Inventors: Choongsun Shin, Yongin (KR); Ohjo Kwon, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 363 days.

(21) Appl. No.: 14/795,574

(22) Filed: Jul. 9, 2015

(65) Prior Publication Data

US 2016/0225302 A1 Aug. 4, 2016

(30) Foreign Application Priority Data

Feb. 3, 2015 (KR) ..... 10-2015-0016738

(51) Int. Cl.
*G09G 3/20* (2006.01)
*G09G 3/3225* (2016.01)

(52) U.S. Cl.
CPC ..... *G09G 3/2003* (2013.01); *G09G 3/3225* (2013.01); *G09G 2300/0413* (2013.01); *G09G 2300/08* (2013.01); *G09G 2320/0233* (2013.01); *G09G 2320/0285* (2013.01); *G09G 2320/0295* (2013.01); *G09G 2320/04* (2013.01); *G09G 2320/043* (2013.01); *G09G 2320/0693* (2013.01); *G09G 2330/026* (2013.01); *G09G 2330/027* (2013.01)

(58) Field of Classification Search
CPC ..... G09G 3/2003; G09G 2300/0413; G09G 2320/04
USPC ..... 345/690
See application file for complete search history.

(56) References Cited

U.S. PATENT DOCUMENTS 8,514,153 B2 * 8/2013 Kohno ..... G09G 3/3233 345/77
10,249,248 B2 * 4/2019 Lee ..... G09G 3/3258
2004/0239610 A1 * 12/2004 Ishii ..... G09G 3/3611 345/100
2006/0060752 A1 3/2006 Lee et al.
2007/0063727 A1 3/2007 Miyake
(Continued)

FOREIGN PATENT DOCUMENTS

KR 10-2006-0026645 A 3/2006
KR 10-2008-0007254 A 1/2008
(Continued)

*Primary Examiner* — William Boddie
*Assistant Examiner* — Bipin Gyawali
(74) *Attorney, Agent, or Firm* — Lewis Roca Rothgerber Christie LLP

(57) ABSTRACT

A sensing apparatus that senses electrical signals of a plurality of pixels arranged in rows or columns. The sensing apparatus includes a plurality of sensing circuits configured to sense electrical signals through sensing lines that correspond to the columns of the pixels, a first switch configured to connect a first sensing line of the sensing lines that corresponds to a first pixel column of the columns of the pixels and a first sensing circuit of the sensing circuits that corresponds to the first pixel column; and a second switch configured to connect the first sensing line and a second sensing circuit of the sensing circuits different from the first sensing circuit.

15 Claims, 9 Drawing Sheets

(56) References Cited

U.S. PATENT DOCUMENTS

| | | | | |
|---|---|---|---|---|
| 2010/0097354 | A1* | 4/2010 | Ahn | G06F 3/042 345/175 |
| 2011/0199395 | A1 | 8/2011 | Nathan et al. | |
| 2012/0312966 | A1* | 12/2012 | Suzuki | G01S 17/89 250/208.1 |
| 2013/0050292 | A1 | 2/2013 | Mizukoshi | |
| 2014/0092076 | A1* | 4/2014 | Lee | G09G 3/3291 345/212 |
| 2014/0176622 | A1 | 6/2014 | Jung et al. | |
| 2014/0247243 | A1* | 9/2014 | Heo | G06F 3/044 345/174 |
| 2015/0130780 | A1 | 5/2015 | Kwon et al. | |
| 2016/0104422 | A1* | 4/2016 | Kishi | G09G 3/3233 345/205 |
| 2016/0163265 | A1* | 6/2016 | Yang | G09G 3/3233 345/690 |
| 2016/0284272 | A1* | 9/2016 | Her | G09G 3/3233 |

FOREIGN PATENT DOCUMENTS

| | | | |
|---|---|---|---|
| KR | 10-2013-0024744 | A | 3/2013 |
| KR | 10-2014-0042456 | A | 4/2014 |
| KR | 10-2014-0083680 | A | 7/2014 |
| KR | 10-2015-0055786 | A | 5/2015 |

* cited by examiner

SENSING APPARATUS, DISPLAY APPARATUS, AND METHOD OF SENSING ELECTRICAL SIGNAL

CROSS-REFERENCE TO RELATED APPLICATION

This application claims priority to and the benefit of Korean Patent Application No. 10-2015-0016738, filed on Feb. 3, 2015, in the Korean Intellectual Property Office, the disclosure of which is incorporated herein in its entirety by reference.

BACKGROUND

1. Field

One or more exemplary embodiments relate to a sensing apparatus, a display apparatus, and a method of sensing an electrical signal.

2. Description of the Related Art

With development of multimedia technology, a flat display apparatus has become increasingly important. In this regard, flat display apparatuses such as liquid crystal display apparatuses, plasma display apparatuses, and organic light-emitting display apparatuses have been generally used.

However, not all manufacturing processes are the same and driving times may be different for each of thin film transistors. Each pixel may have different threshold voltage/mobility characteristics for its driving transistor. Therefore, even when an identical data voltage is applied to each pixel, current amount that flows through the driving transistor of each pixel may be different. The difference in current amount between the driving transistors of the pixels cause a difference in brightness between the pixels, which results in a deterioration in the uniformity of a display screen and the generation of a mura effect.

SUMMARY

One or more exemplary embodiments include a sensing apparatus, a display apparatus, and a method of sensing an electrical signal.

Additional aspects will be set forth in part in the description which follows and, in part, will be apparent from the description, or may be learned by practice of the presented embodiments.

According to one or more exemplary embodiments, a sensing apparatus configured to sense electrical signals of a plurality of pixels arranged in rows and columns includes a plurality of sensing circuits configured to sense the electrical signals through sensing lines that correspond to the columns of the pixels; a first switch configured to connect a first sensing line of the sensing lines that corresponds to a first pixel column of the columns of pixels and a first sensing circuit of the sensing circuits that corresponds to the first pixel column; and a second switch configured to connect the first sensing line and a second sensing circuit of the sensing circuits different from the first sensing circuit.

In some embodiments, the second sensing circuit is adjacent to the first sensing circuit.

In some embodiments, the second sensing circuit corresponds to a second pixel column of the columns of pixels adjacent to the first pixel column.

In some embodiments, the plurality of sensing circuits respectively correspond to k pixel columns of the columns of pixels arranged in succession, the first sensing circuit corresponds to first to $k_{th}$ pixel columns, the first switch is configured to connect the sensing lines respectively corresponding to the first to $k_{th}$ pixel columns of the columns of pixels and the first sensing circuit, and the second switch is configured to connect at least one of the sensing lines respectively corresponding to the first to $k_{th}$ pixel columns and the second sensing circuit.

In some embodiments, the second sensing circuit corresponds to $k+1_{th}$ to $2k_{th}$ pixel columns of the columns of pixels and is adjacent to the first sensing circuit, and the first switch is configured to connect the sensing lines respectively corresponding to the $k+1_{th}$ to $2k_{th}$ pixel columns and the second sensing circuit.

In some embodiments, the sensing apparatus further includes a dummy switch connected to some of the sensing lines from among the sensing lines wherein the some of the sensing lines are not connected to the second sensing circuit corresponding to the first to $k_{th}$ pixel columns.

In some embodiments, a load of the dummy switch is the same or substantially the same as a load of the second switch.

In some embodiments, each of the sensing circuits include an analog-digital converter, and the electrical signals are voltages of emission devices of the plurality of pixels.

In some embodiments, the sensing circuits include an integrator and an analog-digital converter, and the electrical signals are driving currents of emission devices of the plurality of pixels.

According to one or more exemplary embodiments, a display apparatus includes a display panel including a plurality of pixels arranged in rows and columns, and sensing lines that correspond to the columns; and a sensing apparatus configured to sense electrical signals of the plurality of pixels, wherein the sensing apparatus includes a plurality of sensing circuits configured to sense the electrical signals through the sensing lines that correspond to the columns of the pixels; a first switch configured to connect a first sensing line of the sensing lines that corresponds to a first pixel column of the columns of pixels and a first sensing circuit of the sensing circuits that corresponds to the first pixel column; and a second switch configured to connecting the first sensing line and a second sensing circuit of the sensing circuits different from the first sensing circuit.

According to one or more exemplary embodiments, a method of sensing electrical signals of a plurality of pixels arranged in rows and columns by using a sensing apparatus comprising a plurality of sensing circuits that obtain electrical signals of the plurality of pixels through sensing lines corresponding to the columns of the plurality of pixels, and respectively correspond to the plurality of pixel columns, includes obtaining a sensing signal x1 through a first sensing circuit of the sensing circuits that corresponds to a first pixel column of the columns of pixels by sensing an electrical signal of a first pixel of the pixels included in a first pixel column of the columns of pixels; obtaining a sensing signal y1 through a second sensing circuit of the sensing circuits by sensing an electrical signal of the first pixel; and calculating a characteristic variation d between the first sensing circuit and the second sensing circuit based on a difference between the sensing signals x1 and y1.

In some embodiments, the method further includes obtaining a sensing signal x2 through the second sensing circuit that corresponds to a second pixel column of the columns of pixels by sensing an electrical signal of a second pixel of the pixels included in the second pixel column, and compensating for the sensing signal x1 or x2 by using the characteristic variation d.

In some embodiments, the compensating for the sensing signal x1 or x2 includes compensating for the sensing signal x2, and the method further includes outputting the sensing signal x1 as sensing data for the first pixel, and outputting a compensated sensing signal x'2 as sensing data for the second pixel.

In some embodiments, the second pixel column is adjacent to the first pixel column, and the second sensing circuit is adjacent to the first sensing circuit.

In some embodiments, the sensing apparatus further includes a first switch connecting a first sensing line of the sensing lines that corresponds to the first pixel column and the first sensing circuit; and a second switch connecting the first sensing line and the second sensing circuit, wherein in the obtaining of the sensing signal x1, the sensing signal x1 is obtained when the first switch is closed and the second switch is opened, and in the obtaining of the sensing signal y1, the sensing signal y1 is obtained when the first switch is opened and the second switch is closed.

BRIEF DESCRIPTION OF THE DRAWINGS

These and/or other aspects will become apparent and more readily appreciated from the following description of the exemplary embodiments, taken in conjunction with the accompanying drawings in which.

DETAILED DESCRIPTION

Figure 1:
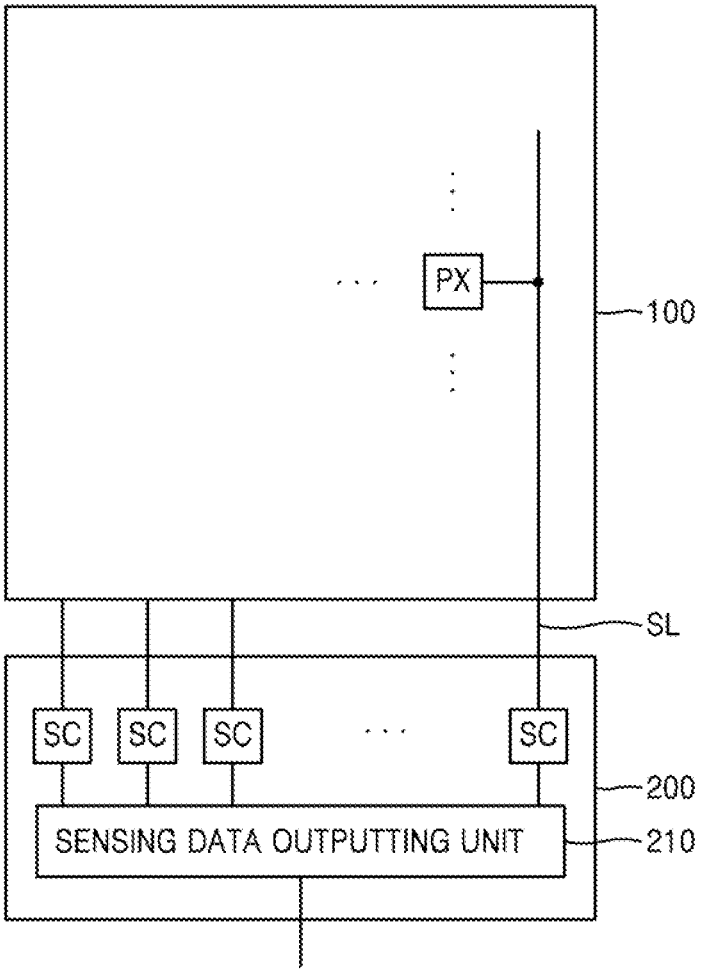
FIG. 1 illustrates a display apparatus according to an embodiment of the present invention.

The inventive concept will now be described more fully hereinafter with reference to the accompanying drawings, in which elements (or components) of embodiments of the present invention are shown. Technical effects of the present invention are not limited thereto, and other unmentioned technical effects will be apparent to one of ordinary skill in the art from the following description. The inventive concept may, however, be embodied in many different forms and should not be construed as being limited to the exemplary embodiments set forth herein.

The attached drawings for illustrating example embodiments are referred to in order to gain a sufficient understanding of the implementation of embodiments of the present invention. Hereinafter, the inventive concept will be described in detail by explaining example embodiments of the inventive concept with reference to the attached drawings. Like reference numerals in the drawings denote like elements (or components).

It will be understood that although the terms "first", "second", etc. may be used herein to describe various components, elements, regions, layers, and/or sections, these components, elements, regions, layers, and/or sections should not be limited by these terms. These terms are only used to distinguish one component, elements, regions, layers, and/or sections from another. Thus, a first element, component, region, layer, or section discussed below could be termed a second element, component, region, layer, or section, without departing from the spirit and scope of the present invention.

As used herein, the singular forms "a" and "an" are intended to include the plural forms as well, unless the context clearly indicates otherwise. It will be further understood that the terms "comprise," "includes," "including," "include," "comprises" and/or "comprising" used herein specify the presence of stated features, integers, steps, operations, elements, and/or components, but do not preclude the presence or addition of one or more other features, integers, steps, operations, elements, and/or components. Sizes of elements (or components) in the drawings may be exaggerated for convenience of explanation. In other words, since sizes and thicknesses of components in the drawings may be arbitrarily illustrated for convenience of explanation, the following the present invention is not limited thereto.

As used herein, the term "and/or" includes any and all combinations of one or more of the associated listed items. Expressions such as "at least one of," when preceding a list of elements, modify the entire list of elements and do not modify the individual elements of the list. Further, the use of "may" when describing embodiments of the present invention refers to "one or more embodiments of the present invention." Also, the term "exemplary" is intended to refer to an example or illustration.

It will be understood that when an element or layer is referred to as being "on," "connected to," "coupled to," "connected with," "coupled with," or "adjacent to" another element or layer, it can be "directly on," "directly connected to," "directly coupled to," "directly connected with," "directly coupled with," or "directly adjacent to" the other element or layer, or one or more intervening elements or layers may be present. Further "connection," "connected," etc. may also refer to "electrical connection," "electrically connect," etc. depending on the context in which they are used as those skilled in the art would appreciate. When an element or layer is referred to as being "directly on," "directly connected to," "directly coupled to," "directly connected with," "directly coupled with," or "immediately adjacent to" another element or layer, there are no intervening elements or layers present.

As used herein, the terms "use," "using," and "used" may be considered synonymous with the terms "utilize," "utilizing," and "utilized," respectively.

A person of skill in the art should also recognize that the process may be executed via hardware, firmware (e.g. via an ASIC), or in any combination of software, firmware, and/or hardware. Furthermore, the sequence of steps of the process is not fixed, but can be altered into any desired sequence as recognized by a person of skill in the art. The altered sequence may include all of the steps or a portion of the steps.

FIG. 1 illustrates a display apparatus according to an embodiment.

The display apparatus according to an embodiment may include a display panel 100 and a sensing apparatus 200. The display panel 100 of the display apparatus according to an embodiment may include a plurality of pixels PX for displaying an image. The display apparatus may be an organic emission display apparatus, and each of the pixels PX may include a pixel circuit and an emission device. However, the present invention is not limited thereto and types of display apparatuses according to different embodiments may vary. Although only one pixel PX is illustrated in FIG. 1, the display panel 100 may include a plurality of pixels PX formed in a matrix in which the pixels PX are arranged in rows and columns thereof.

Although not illustrated in FIG. 1, a plurality of scan lines and data lines may be formed in the display panel 100, and pixels PX may be formed in respective regions defined by crossing scan lines and data lines. The display apparatus may further include a scan driver for applying a scan signal to a scan line, a data driver for applying a data signal to a data line, a controller, a memory, and/or the like.

A scan line connected to the pixels PX in a row transmits a scan signal thereto. A data line connected to the pixels PX in a column transmits a data signal thereto.

A sensing line SL is provided for each column of the pixels PX on the display panel 100. The sensing line SL transmits an electrical signal of each of the pixels PX to the sensing apparatus 200. Hereinafter, one or more embodiments have a sensing line SL, corresponding to each column of the pixels PX, but the present invention is not limited thereto. The sensing line SL may correspond to two or more columns of the pixels PX, and the display panel 100 may include more lines than illustrated in the drawings.

The sensing apparatus 200 senses electrical signals of the pixels PX included in the display panel 100, and outputs sensing data of each of the pixels PX. The sensing apparatus 200 may be configured as an integrated circuit or an integrated circuit package including a plurality of semiconductor components.

The sensing apparatus 200 may include a plurality of sensing circuits SC and a sensing data output unit (e.g., a sensing data outputter) 210. Each of the sensing circuits SC obtains an electrical signal of the pixel PX through a sensing line SL to output a sensing signal. The electrical signal may have an analog value, and the sensing signal may have a digital value, but the present invention is not limited thereto. The sensing data output unit 210 processes the sensing signal to output sensing data.

The sensing circuit SC is provided for at least one column of the pixels PX, and obtains an electrical signal of each of the pixels PX through a sensing line SL provided for each column of the pixels PX to output a sensing signal. The sensing circuit SC may include a device such as an analog-digital converter (ADC) or an integrator. For example, the sensing circuit SC may include an analog-digital converter for sensing an end-to-end voltage of a light-emitting device of a pixel PX. In some embodiments, the sensing circuit SC may include an analog-digital converter and an integrator to sense a driving current of a light-emitting device or a pixel PX. However, the sensing circuit SC is not limited thereto, and may include other or different components or elements.

The sensing apparatus 200 according to an embodiment senses electrical signals of every pixel PX included in the display panel 100, not by using one sensing circuit SC, but by using a plurality of sensing circuits SC. In this regard, a characteristic variation of the sensing circuits SC may cause an error in a sensing value of the electrical signals.

The sensing circuit SC may include an analog-digital converter, and the analog-digital converter may have a gain error and an offset error. In a manufacturing process of a data driving integrated circuit, process conditions may vary, and thus there may be errors or discrepancies between analog-digital converters in the data driving integrated circuit.

The sensing apparatus 200 according to an embodiment obtains a characteristic variation between the sensing circuits SC to compensate for a sensing error caused by a characteristic variation between the sensing circuits SC and compensated for a sensing result by considering the characteristic variation. The sensing apparatus 200 according to an embodiment does not use a predetermined constant value as a characteristic variation between the sensing circuits SC, but directly calculates the characteristic variation by using a first switch S1 and a second switch S2. (see FIG. 2) Thus, even when a characteristic variation between sensing circuits SC of a display apparatus changes after manufacturing, an accurate characteristic variation may be calculated to compensate for changes in sensing results. A detailed method will be explained later by referring to the drawings.

A display apparatus according to an embodiment obtains sensing data of an electrical signal of a pixel PX, and thus analyzes a characteristic variation of the pixel PX to compensate image data. In this regard, a mura (e.g., unevenness; irregularity; lack of uniformity; or non-uniformity) effect on image caused by a characteristic variation of a pixel PX may be reduced.

Figure 2:
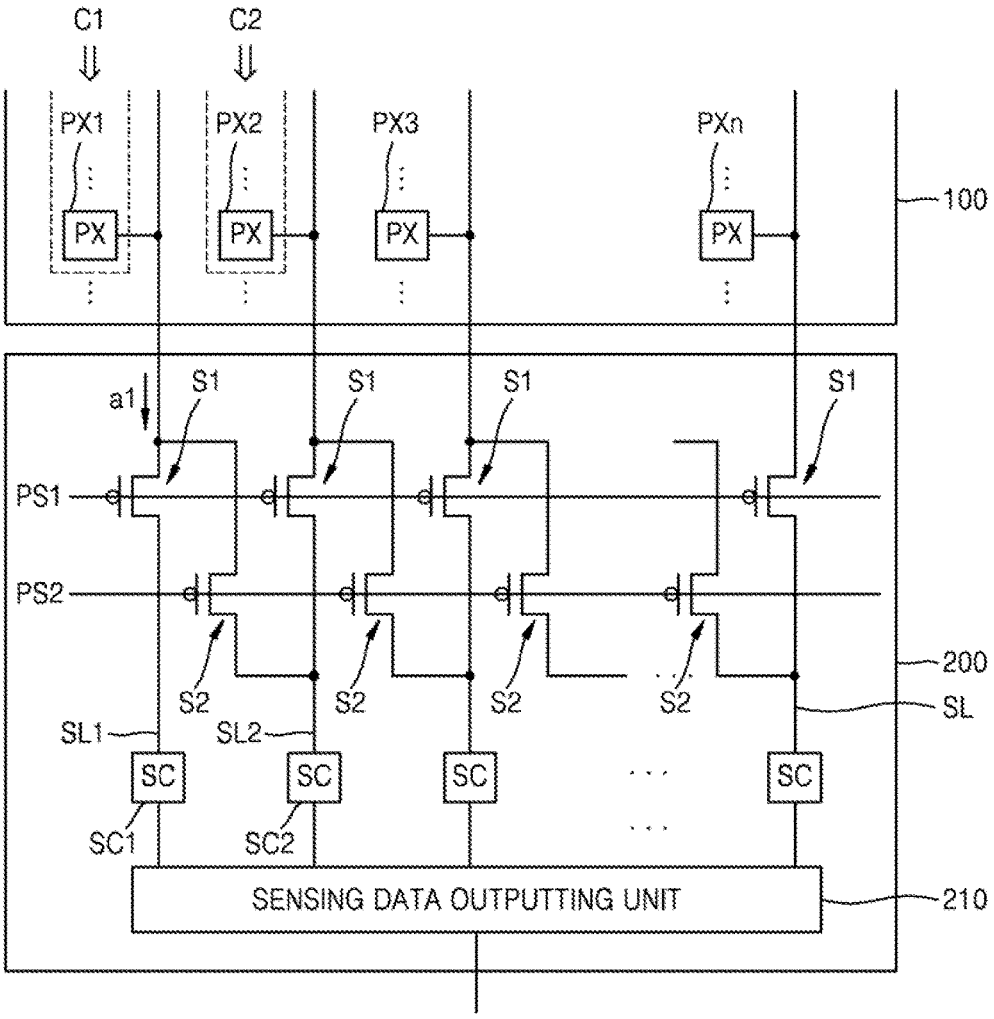
FIG. 2 illustrates a detailed view of the sensing apparatus 200 according to an embodiment of the present invention.

FIG. 2 illustrates a detailed view of the sensing apparatus 200 according to an embodiment.

Referring to FIG. 2, the sensing apparatus 200 according to an embodiment may include a plurality of sensing circuits SC, a plurality of first switches S1, and a plurality of second switches S2.

A sensing circuit SC may be provided to correspond to at least one pixel column, and in FIG. 2, sensing circuits SC are provided to correspond to each of the pixel columns included in the sensing apparatus 200. The sensing circuit SC obtains an electrical signal of a pixel PX through a sensing line SL to output a sensing signal. For example, when an electrical signal is an analog value, the sensing signal SC converts the electrical signal with the analog value to a sensing signal with a digital value in order to output the sensing signal.

A first switch S1 and a second switch S2 connect a sensing line SL and a sensing circuit SC. The first switch S1 connects a sensing line provided to correspond to a certain pixel column to a first sensing circuit provided to correspond to the certain pixel column. The second switch S2 connects a sensing line provided to correspond to the certain pixel column to a second sensing circuit. In other words, an electrical signal transmitted through the sensing line provided to correspond to the certain pixel column is sensed by the first sensing circuit when the first switch S1 is closed and is sensed by the second sensing circuit when the second switch S2 is closed. Therefore, one electrical signal is sensed twice by different sensing circuits. The second sensing circuit may be formed adjacent to the first sensing circuit when taking into account the layout design of a wiring and device, but the present invention is not limited thereto.

For example, the first switch S1 connects a first sensing line SL1, corresponding to a first pixel column C1, and a first sensing circuit SC1, corresponding to the first pixel column C1. A second switch S2 illustrated in FIG. 2 connects the first sensing line SL1, corresponding to the first pixel column C1, and a second sensing circuit SC2. In FIG. 2, a second switch is illustrated to connect a sensing line of a pixel column, corresponding to the first sensing circuit SC1, and the second sensing circuit SC2, adjacent to the first sensing circuit SC1, but the present invention is not limited thereto. For example, a second switch may connect a sensing line of a pixel column, corresponding to the first sensing circuit SC1, and a sensing circuit that is not adjacent to the first sensing circuit SC1. An electrical signal a1 transmitted through the first sensing line SL1 is sensed by the first sensing circuit SC1 when the first switch S1 is closed while the electrical signal a1 is sensed by the second sensing circuit SC2 when the second switch S2 is closed.

The first switch S1 operates in response to a first switch activation signal PS1, and the second switch S2 operates in response to a second switch activation signal PS2. The sensing data output unit 210 generates the first switch activation signal PS1 and the second switch activation signal PS2 to open or close the first switch S1 and the second switch S2. The sensing data output unit 210 may obtain (or measure) a sensing signal by opening or closing the first switch S1 and the second switch S2. The first switch activation signal PS1 and the second switch activation signal PS2 may be generated based on a scan signal input to a scan line of the display panel 100, but the present invention is not limited thereto. The first switch activation signal PS1 and the second switch activation signal PS2 may be provided by a controller other than the sensing data output unit 210.

In FIG. 2, the first switch S1 and the second switch S2 are illustrated as transistors, but the present invention is not limited thereto. The first switch S1 and the second switch S2 may be embodied in a various circuit form that may provide a switching function.

Figure 3:
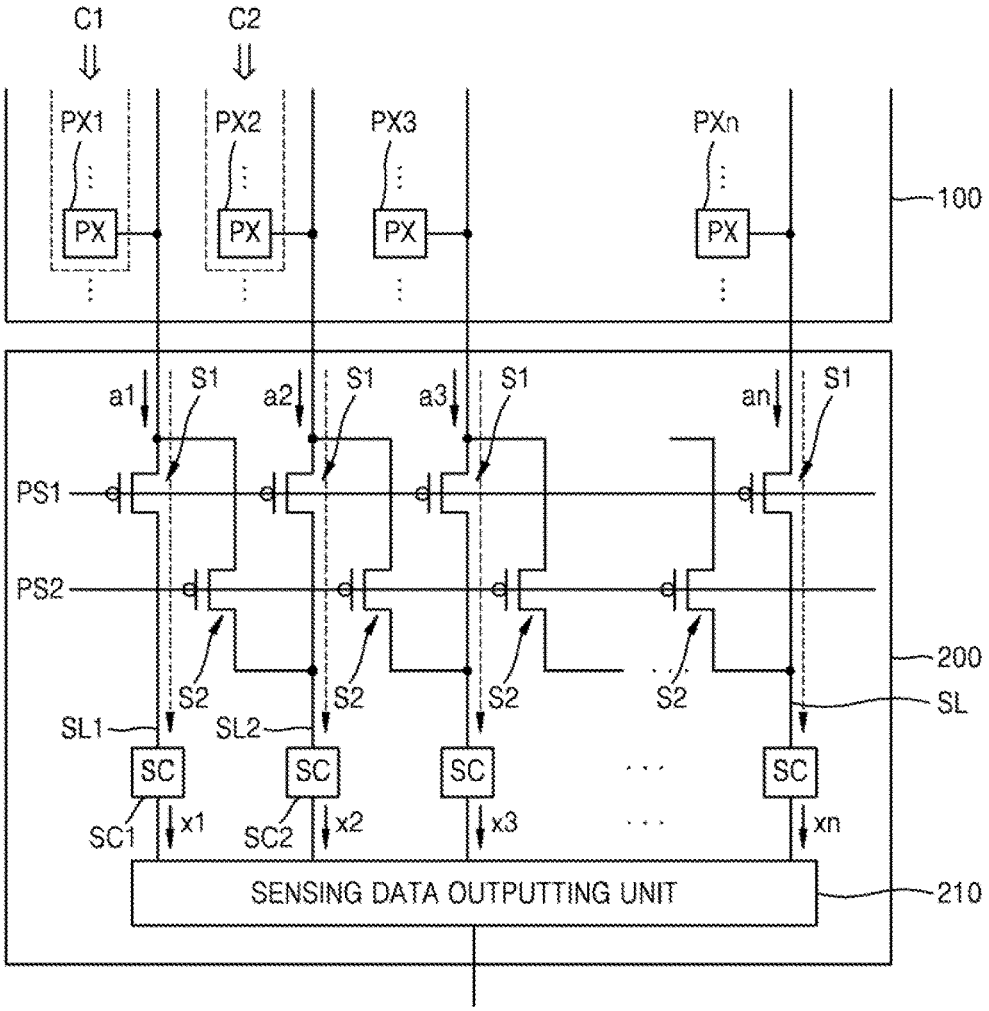
FIG. 3 illustrates a state in which the first switch S1 in FIG. 2 is closed.

FIG. 3 illustrates a state in which the first switch S1 in FIG. 2 is closed.

FIG. 3 illustrates the state of the sensing apparatus 200, in which the first switch S1 is closed in response to the first switch activation signal PS1, and the second switch S2 is opened in response to the second switch activation signal PS2.

The sensing apparatus 200 according to an embodiment senses electrical signals a1, a2, . . . , an of a plurality of pixels PX1, PX, . . . , PXn, which are included in a row. The sensing apparatus 200 may repeat a process of sensing electrical signals a1, a2, . . . , an of a plurality of pixels PX1, PX, . . . , PXn, which are included in a row, for a plurality of rows. In this regard, the sensing apparatus 200 may sense electrical signals of every pixels PX of the display panel 100.

Referring to FIG. 3, when the first switch S1 is closed and the second switch S2 is opened, a plurality of sensing circuits SC output sensing signals x1, x2, . . . , xn. A sensing value of a sensing signal {xn} is determined by a sensing circuit {SCn} that senses an electrical signal {an} of a pixel {PXn}. For example, in FIG. 3, a sensing value of the sensing signal x1 is determined by the first sensing circuit SC1 that senses the electrical signal a1 of the first pixel PX1, and a sensing value of the sensing signal x2 is determined by the second sensing circuit SC2 that senses the electrical signal a2 of the second pixel PX2. In FIG. 3, a path for the electrical signals a1, a2, . . . , an to be input to the sensing circuits SC1, SC2, . . . , SCn is illustrated as a dotted line.

Figure 4:
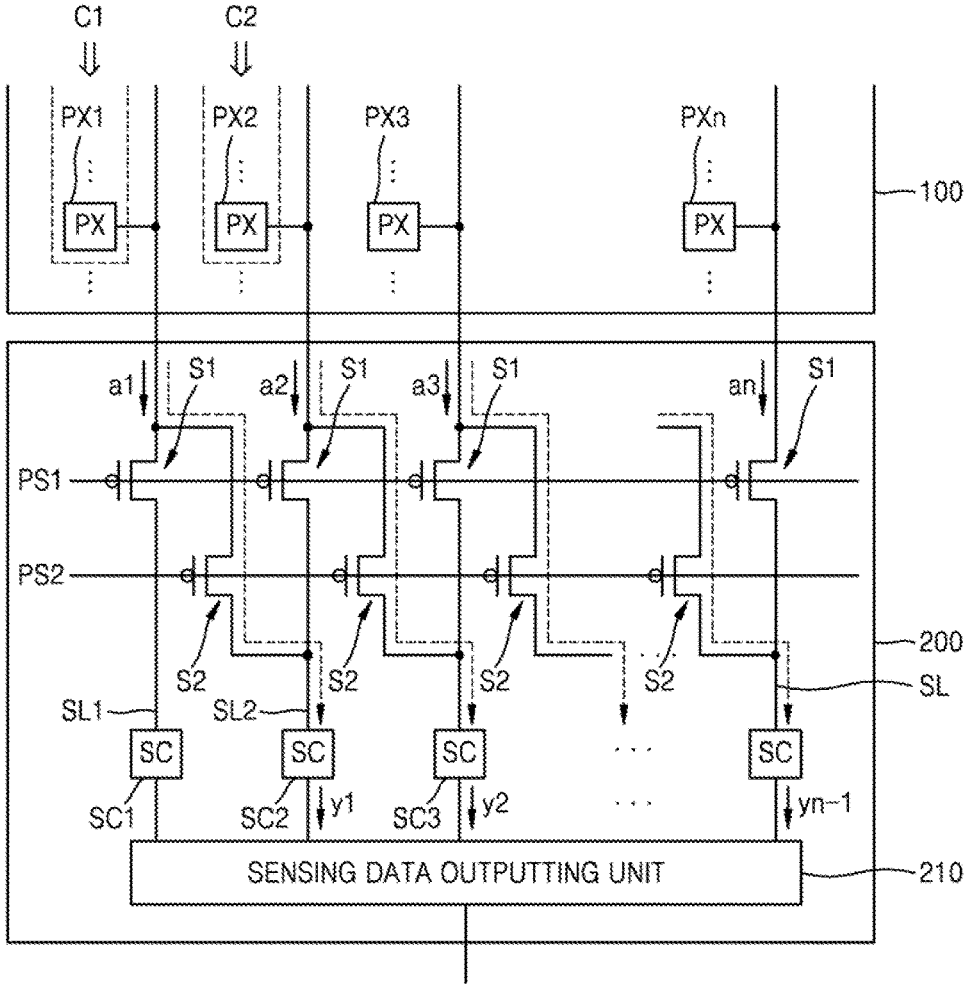
FIG. 4 illustrates a state in which the second switch S2 in FIG. 2 is closed.

FIG. 4 illustrates a state in which the second switch S2 in FIG. 2 is closed.

FIG. 4 illustrates the state of the sensing apparatus 200, in which the first switch S1 is opened in response to the first switch activation signal PS1, and the second switch S2 is closed in response to the second switch activation signal PS2.

Referring to FIG. 4, when the first switch S1 is opened and the second switch S2 is closed, the sensing circuits SC output sensing signals y1, y2, yn−1. A sensing value of a sensing signal {yn−1} is determined by a sensing circuit {SCn} that senses an electrical signal {an−1} of a pixel {PXn−1}. For example, in FIG. 4, a sensing value of the sensing signal y1 is determined by the second sensing circuit SC2 that senses the electrical signal a1 of the first pixel PX1, and a sensing value of the sensing signal y2 is determined by the third sensing circuit SC3 that senses the electrical signal a2 of the second pixel PX2. In FIG. 4, a path for the electrical signals a1, a2, . . . , an−1 to be input to the sensing circuits SC2, SC3, . . . , SCn is illustrated as a dotted line.

Referring to FIGS. 3 and 4, a method to compensate for a sensing signal {xn} by calculating a characteristic variation of each of sensing circuits SC will be explained. The sensing data output unit 210 uses a sensing signal {xn} and a sensing signal {yn} to calculate a characteristic variation of each of sensing circuits SC.

When the characteristic variations of each of the sensing circuit SC are calculated, one of the characteristic variations of the sensing circuits SC may be determined as a reference value. For example, a characteristic variation of the first sensing circuit SC1 may be determined as the reference value, and thus the other characteristic variations may be calculated based on the characteristic variation of the first sensing circuit SC1. The sensing data output unit 210 may calculate a characteristic variation of each sensing circuit SC by using Equation 1 below.

$$d[1]=0$$

$$d[i]=d[i-1]+y[i-1]-x[i-1],\ i=2,3,\ldots,N \qquad \text{Equation 1}$$

In Equation 1, d[i] denotes a characteristic variation of a sensing circuit SC. For example, d[1] denotes a characteristic variation of the first sensing circuit SC1, d[2] denotes a characteristic variation of the second sensing circuit SC2, and N denotes the number of the sensing circuits SC. When the characteristic of the first sensing circuit SC1 becomes a reference to calculate a variation, d1 may be set to 0.

Referring to Equation 1, an identical electrical signal is measured by two sensing circuits SC and a difference in the measurement is used to calculate a characteristic variation between the two sensing circuits SC. For example, an identical electrical signal a1 is measured by two sensing circuits SC1 and SC2 and the results thereof are x1 and y1. The difference between the results of the two sensing circuits SC1 and SC2, which is y1−x1, is used to calculate a characteristic variation d2 between the first sensing circuit SC1 and the second sensing circuit SC2. Also, an identical electrical signal a2 is measured by two sensing circuits SC2 and SC3 and the results thereof are x2 and y2. The difference between the results of the two sensing circuits SC2 and SC3, which is y2−x2, is used to calculate a characteristic variation between the second sensing circuit SC2 and the third sensing circuit SC3. The calculated variation between the second sensing circuit SC2 and the third sensing circuit SC3 is added to d2 to calculate a characteristic variation d3 between the first sensing circuit SC1 and the third sensing circuit SC3.

In Equation 1, a subtraction is used to calculate a characteristic variation of a sensing circuit SC, but the present invention is not limited thereto. The sensing data output unit 210 may obtain a characteristic variation of a sensing circuit SC by using various suitable calculation methods and a combination thereof.

When a characteristic variation is calculated from Equation 1, the sensing data output unit 210 compensates for an error caused by the characteristic variation of the sensing circuit SC by using Equation 2 with respect to a sensing signal {xn}.

$$x'[i]=x[i]-d[i],\ i=1,2,\ldots,n \qquad \text{Equation 2}$$

x'[i] in Equation 2 is a final sensing data for which an error caused by a characteristic variation of a sensing circuit SC is compensated. In FIGS. 2 to 4, x'[1] is sensing data for the first pixel PX1, and x'[2] is sensing data for the second pixel PX2. n in Equation 2 is the number of the pixel columns. Equation 1 and 2 are applied to the embodiments of FIGS. 2 to 4, and the number of the sensing circuits SC in FIGS. 2 to 4 is the same as the number of the pixel columns, that is, n=N.

Figure 5:
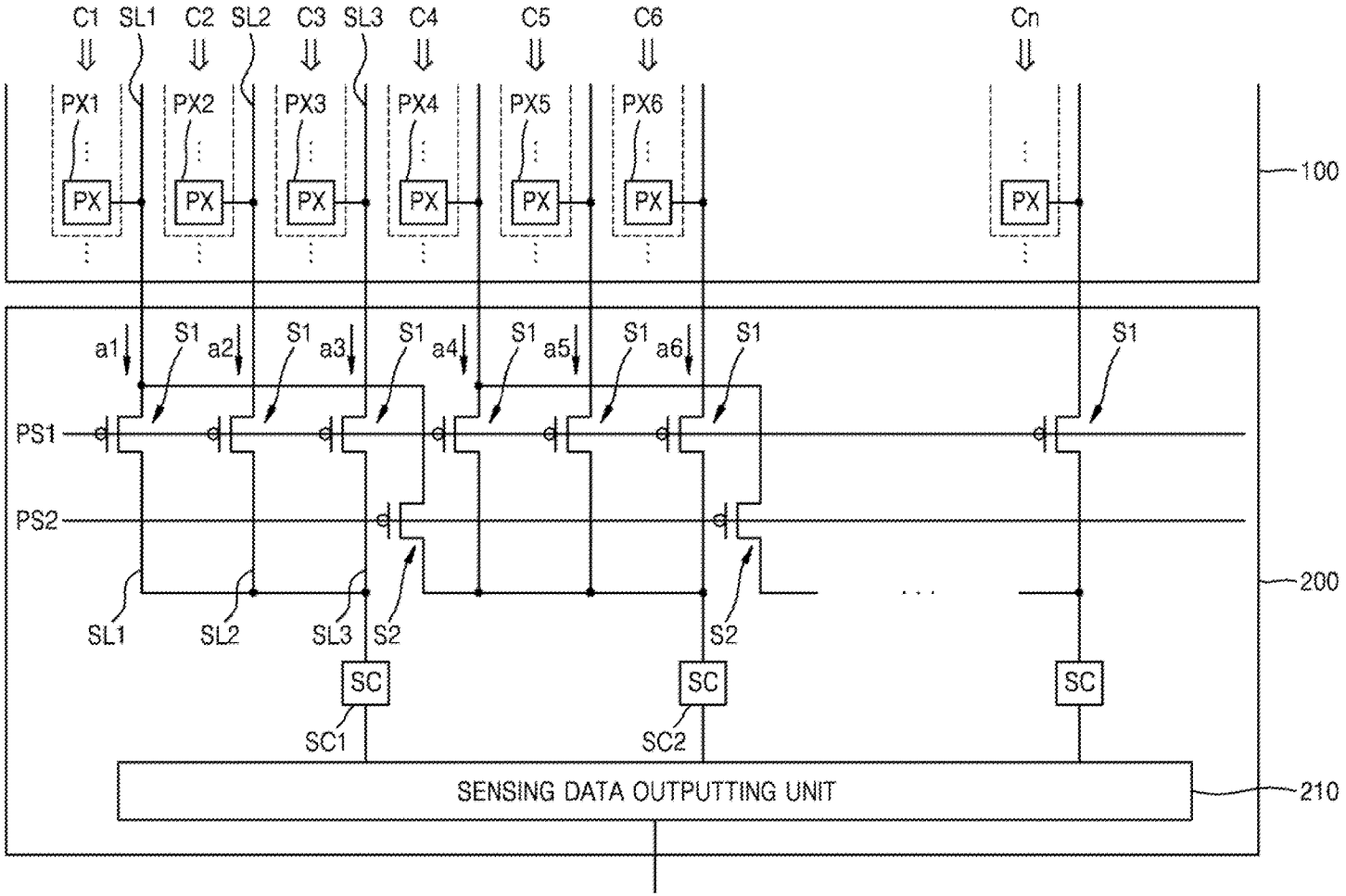
FIG. 5 illustrates another embodiment of the sensing apparatus 200.

FIG. 5 illustrates another embodiment of the sensing apparatus 200.

Referring to FIG. 5, the sensing apparatus 200 according to another embodiment may include a plurality of sensing circuits SC, a plurality of first switches S1, and a plurality of second switches S2. The sensing apparatus 200 in FIG. 5 is another embodiment of the sensing apparatus 200 in FIG. 2, and thus, descriptions of identical components are the same or substantially the same as described in FIG. 2.

The sensing apparatus 200 according to another embodiment may have a sensing circuit SC that corresponds to a plurality of pixel columns when the number of sensing circuits SC is limited by space and cost. For example, a sensing circuits SC may correspond to k pixel columns arranged in succession Technical features described above may also be applied. In FIG. 5, a single sensing circuit SC corresponds to three pixel columns, that is, k is 3 herein. However, the present invention is not limited thereto.

Referring to FIG. 5, a first sensing circuit SC1 corresponds to a first to third pixel columns C1, C2, and C3, and the second sensing circuit SC2 corresponds to a fourth to sixth pixel columns C4, C5, and C6. Each of the sensing circuits SC obtains respective electrical signals of the pixels PX included in the plurality of pixel columns. For example, the first sensing circuit SC1 obtains an electrical signal a1 of a first pixel PX1 included in the first pixel column C1, an electrical signal a2 of a second pixel PX2 included in the second pixel column C2, and an electrical signal a3 of a third pixel PX3 included in the third pixel column C3. A second sensing circuit SC2 obtains an electrical signal a4 of a fourth pixel PX4 included in the fourth pixel column C4, an electrical signal a5 of a fifth pixel PX5 included in the fifth pixel column C5, and an electrical signal a6 of a sixth pixel PX6 included in the sixth pixel column C6.

In order for a plurality of electrical signals, for example, the electrical signals a1, a2, and a3, to be sensed by a single sensing circuit SC, for example, the first sensing circuit SC1, the sensing circuit SC may further include another circuit that may classify and obtain the plurality of electrical signals. For example, the sensing circuit SC may include a multiplexer, but the present invention is not limited thereto.

A first switch S1 and a second switch S2 connect a sensing line SL and a sensing circuit SC. The first switch S1 connects sensing lines SL, corresponding to a plurality of pixel columns, to a sensing circuit SC, corresponding to the pixel columns. The second switch S2 connects sensing lines SL, corresponding to the pixel columns, to the sensing circuit SC, that is adjacent to the sensing circuit SC corresponding to the pixel columns.

Referring to FIG. 5, as an example, the first switch S1 connects each of the sensing lines SL, corresponding to first to kth columns C1, to Ck to the first sensing circuit SC1. Also, the first switch S1 connects each of the sensing lines SL, corresponding to k+1th to 2kth columns Ck+1 to C2k, to the second sensing circuit SC2.

Referring to FIG. 5, the second switch S2 connects at least one of the sensing lines SL, corresponding to the first to kth columns C1 to Ck, to the second sensing circuit SC2. The second switch S2 in FIG. 5 connects the first sensing line SL1, corresponding to the first pixel column C1 from among the sensing lines SL corresponding to the first to kth pixel column C1 to Ck, to the second sensing circuit SC2. However, the present invention is not limited thereto.

The sensing apparatus 200 may also include a plurality of second switches S2 that connect each of the sensing lines SL1, SL2, and SL3 to the second sensing circuit SC2.

Referring to FIG. 5, the electrical signal a1 of the first pixel PX1, transmitted through the sensing line SL1 corresponding to the first pixel column C1, is sensed by the first sensing circuit SC1 when the first switch S1 is closed, and sensed by the second sensing circuit SC2 when the second switch S2 is closed. In this regard, the electrical signal a1 is sensed by two different sensing circuits SC1 and SC2.

Figure 6:
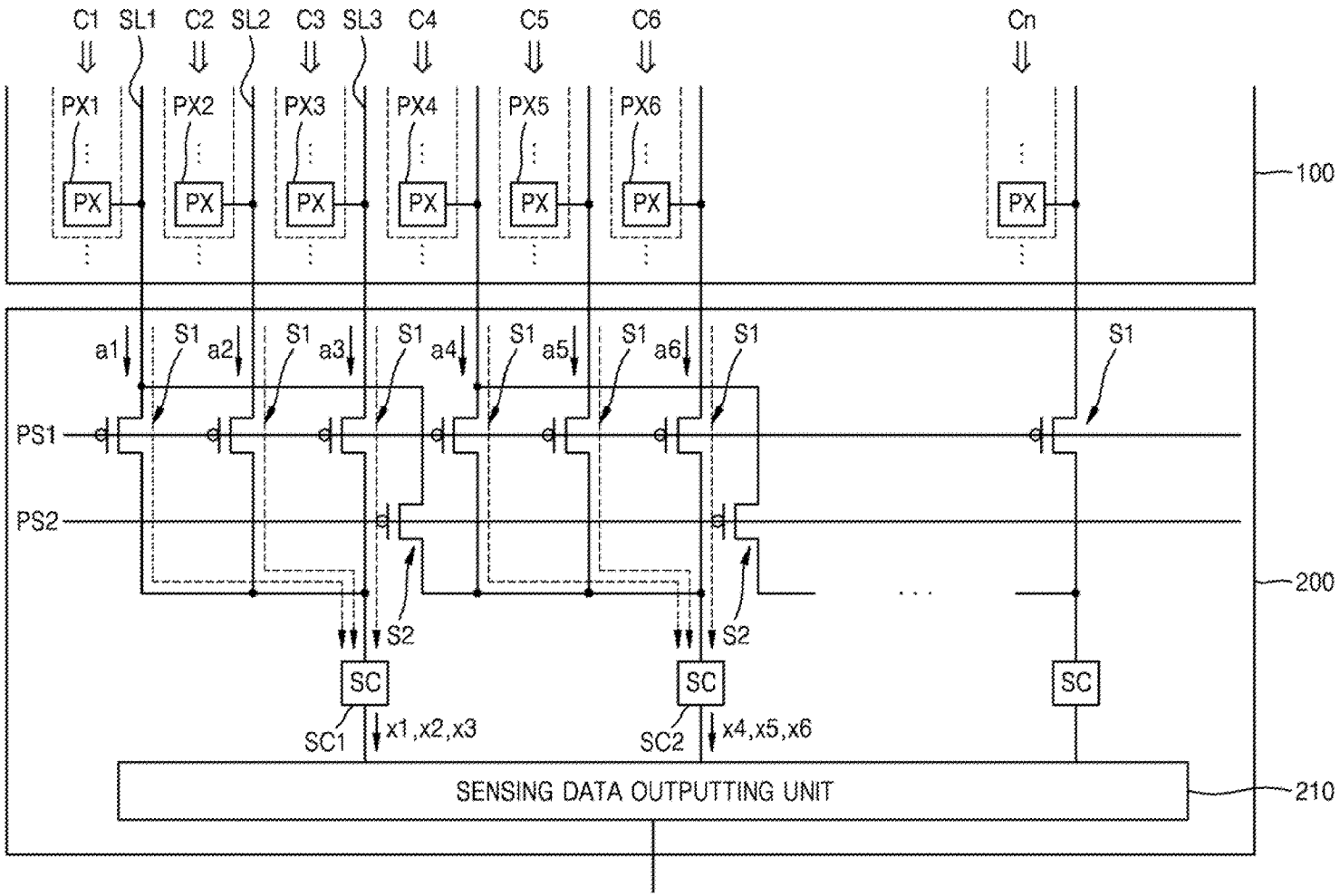
FIG. 6 illustrates a state in which the first switch S1 in FIG. 5 is closed.

FIG. 6 illustrates a state in which the first switch S1 in FIG. 5 is closed.

Referring to FIG. 6, the sensing apparatus 200 has the first switch S1 closed in response to the first switch activation signal PS1, and the second switch S2 opened in response to the second switch activation signal PS2.

The sensing apparatus 200 according to another embodiment performs a process of sensing the electrical signals a1, a2, . . . , and an of the pixels PX1, PX, . . . , and PXn that are included in a row. The sensing apparatus 200 may repeat the aforementioned process for a plurality of rows. In this regard, electrical signals with respect to every pixel PX included in the display panel 100 may be sensed.

Referring to FIG. 6, when the first switch S1 is closed and the second switch S2 is opened, the sensing circuits SC output sensing signals x1, x2, . . . , and xn by sensing the electrical signals a1, a2, . . . , and an. A sensing value of a sensing signal {xn} is determined by a sensing circuit {SC[(n−1)/k]+1} that senses an electrical signal {an} of a pixel {PXn}. (wherein, [(n−1)/k] is a step function of (n−1)/k) Referring to FIG. 6, a sensing value of the sensing signal x1 is determined by the first sensing circuit SC1 that senses the electrical signal a1 of the first pixel PX1, and a sensing value of the sensing signal x2 is determined by the first sensing circuit SC1 that senses the electrical signal a2 of the second pixel PX2. In FIG. 6, paths for the electrical signals a1, a2, . . . , and an to be input to the sensing circuits SC1, SC2, . . . , and SC[(n−1)/k]+1 are illustrated as dotted lines.

In some embodiments, each of the sensing circuits SC may obtain a plurality of electrical signals, and may output a plurality of sensing signals. For example, the first sensing circuit SC1 obtains a plurality of electrical signals a1, a2, and a3, and outputs a plurality of sensing signals x1, x2, and x3.

Figure 7:
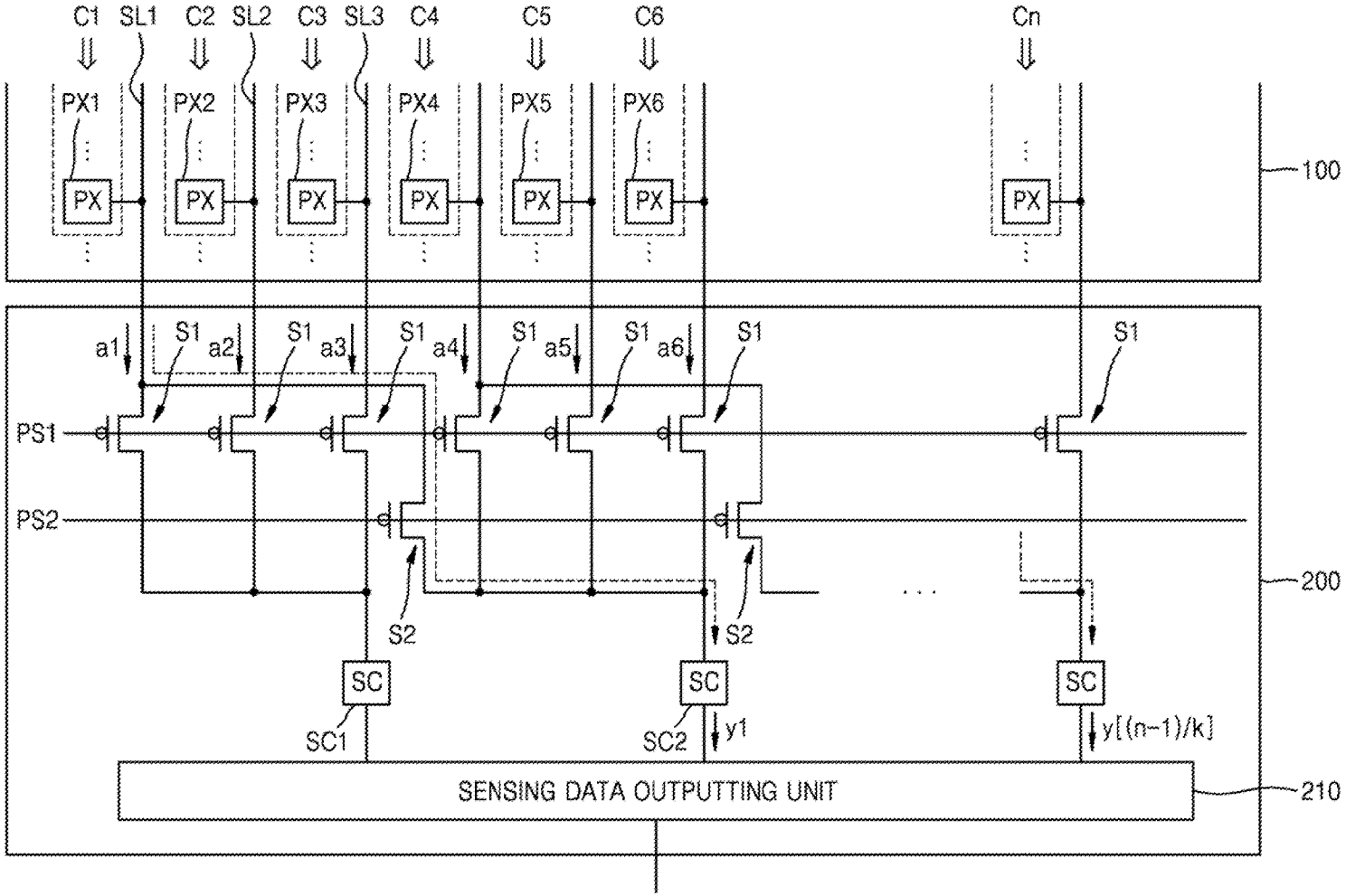
FIG. 7 illustrates a state in which the second switch S2 in FIG. 5 is closed.

FIG. 7 illustrates a state in which the second switch S2 in FIG. 5 is closed.

Referring to FIG. 7, the sensing apparatus 200 is illustrated where the first switch S1 is opened in response to the first switch activation signal PS1, and the second switch S2 is closed in response to the second switch activation signal PS2.

Referring to FIG. 7, When the first switch S1 is opened and the second switch S2 is closed, the plurality of sensing circuits SC output sensing signals y1, y2, . . . , and y[(n−1)/k]. A sensing signal {yn} is a sensing value for a sensing circuit {SC[(n−1)/k]+2} that senses an electrical signal {an} of a pixel {PXn}. For example, the sensing value of the sensing signal y1 is determined by the second sensing circuit SC2 that senses the electrical signal a1 of the first pixel PX1. In FIG. 7, a path for the electrical signal a1 of the first pixel PX to be input to the second sensing circuit SC2 is illustrated as a dotted line.

Referring to FIGS. 6 and 7, a method of compensating for the sensing signal {xn} by calculating the characteristic variation of the sensing circuits SC is described. The sensing data output unit 210 calculates the characteristic variation of each of the sensing circuits SC by using the sensing signal {xn} and the sensing signal {yn}.

When calculating the characteristic variation of the sensing circuit SC, a characteristic of a sensing circuit (e.g., a predetermined sensing circuit) SC may be determined as a reference. For example, characteristic variations of other sensing circuits SC may be calculated based on the characteristic of the first sensing circuit SC1, which is used as the reference. The sensing data output unit 210 may calculate the characteristic variation of each of the sensing circuits SC from Equation 3 below.

$$d[1]=0$$

$$d[i]=d[i-1]+y[k(i-1)+1]-x[k(i-1)+1],\ i=2,3,\ldots,N \qquad \text{Equation 3}$$

In Equation 3, d[i] is the characteristic variation of the sensing circuit SC[i]. For example, d[1] is the characteristic variation of the first sensing circuit SC1, and d[2] is the characteristic variation of the second sensing circuit SC2. N is the number of the sensing circuits SC. When calculating a variation by setting the characteristic of the first sensing circuit SC1 as the reference, d1 is set to be 0.

Referring to Equation 3, the sensing data output unit 210 calculates the characteristic variation between two sensing circuits SC from the difference of the measurement results obtained by using two sensing circuits SC to measure the same electrical signal. For example, the electrical signal a1 is measured by the two sensing circuits SC1 and SC2 and measurement results x1 and y1 are obtained. The difference between the measurement results, y1−x1, is used to calculate the characteristic variation d2 between the first sensing circuit SC1 and the second sensing circuit SC2.

Equation 3 shows how the apparatus 200 illustrated in FIGS. 5 to 7 calculates the characteristic of the sensing circuit SC. When a structure of a sensing apparatus is modified, Equation 3 may also be changed.

The sensing data output unit 210 compensates for the characteristic variation of the sensing circuit SC for the sensing signals {xn} according to Equation 4 below.

$$x'[i]=x[i],\ i=1,2,\ldots,k$$

$$x'[i]=x[i]-d[2],\ i=k+1,k+2,\ldots,2k$$

$$x'[i]=x[i]-d[3],\ i=2k+1,2k+2,\ldots,3k$$

$$x'[i]=x[i]-d[N],\ i=n-k+1,n-k+2,\ldots,n \qquad \text{Equation 4}$$

In Equation 4, x'[i] is final sensing data, in which an error caused by the characteristic variation of the sensing circuit SC has been compensated for. In FIGS. 5 to 7, x'[1] is sensing data of the first pixel PX1, and x'[2] is sensing data of the second pixel PX2. Cases where k is 3 are illustrated in FIGS. 5 to 7, and thus, Equation 5 may be obtained by substituting k=3 into Equation 4.

$$x'[i]=x[i],\ i=1,2,3$$

$$x'[i]=x[i]-d[2],\ i=4,5,6$$

$$x'[i]=x[i]-d[3],\ i=7,8,9$$

$$x'[i]=x[i]-d[N],\ i=n-2,n-1,\ldots,n \qquad \text{Equation 5}$$

Figure 8:
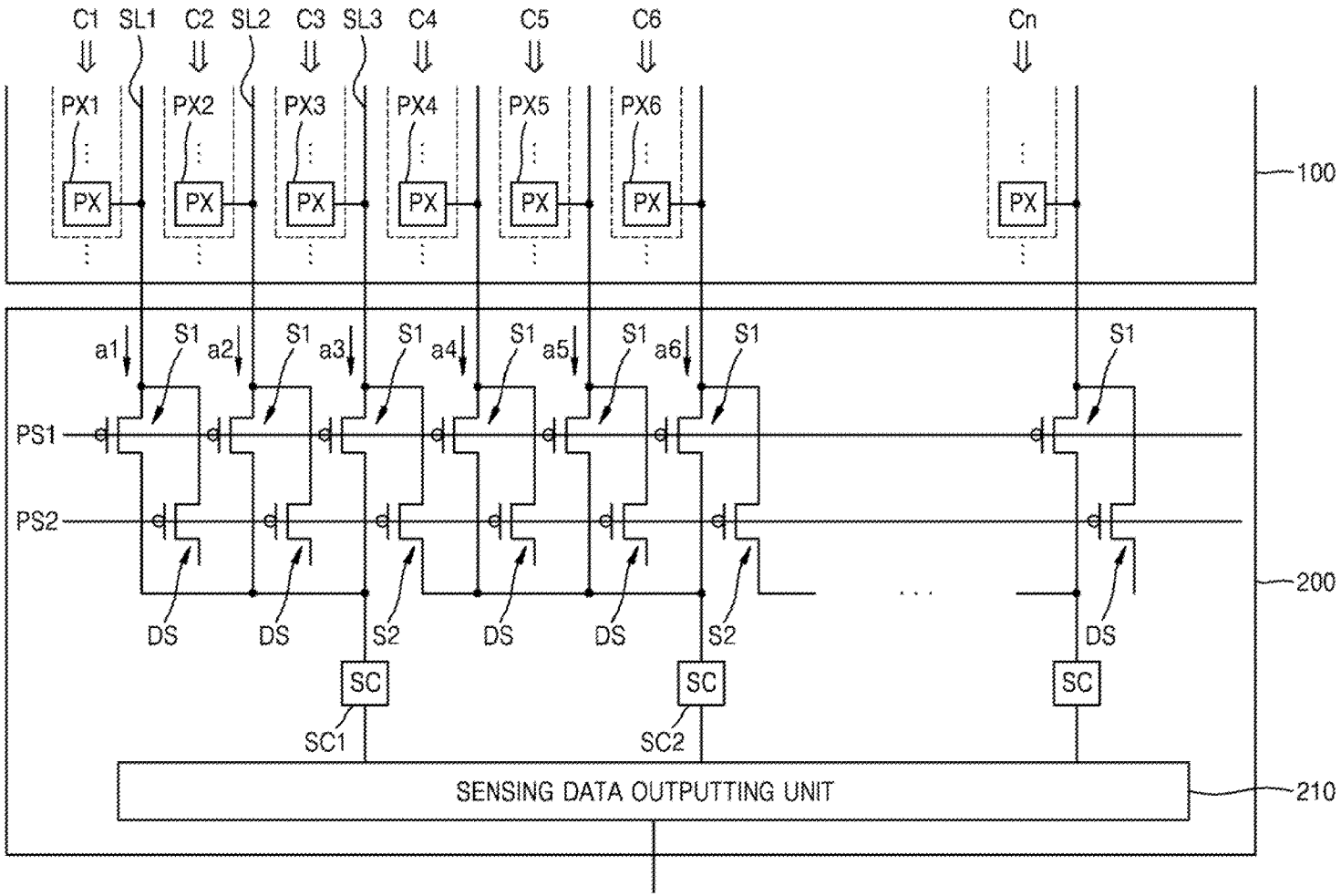
FIG. 8 illustrates a sensing apparatus 200 according to yet another embodiment of the present invention.

FIG. 8 illustrates a sensing apparatus 200 according to another embodiment.

A second switch S2 connects any one sensing line from among sensing lines SL1, SL2, and SL3 for a plurality of columns C1, C2, and C3, that correspond to a first sensing circuit SC1, to a second sensing circuit SC2. In FIGS. 5 to 7, the second switch S2 connects the first sensing line SL1 from among the sensing lines SL1, SL2, and SL3 for the pixel columns C1, C2, and C3, that correspond to the first sensing circuit SC1, to the second sensing circuit SC2. However, the present invention is not limited thereto. For example, as illustrated in FIG. 8, the second switch S2 may connect the third sensing line SL3 to the second sensing circuit SC2.

Referring to FIG. 8, the sensing apparatus 200 may further include a dummy switch DS. The dummy switch DS is connected to sensing lines SL that are not connected to the second switch S2. Load of the dummy switch DS applied to the sensing line SL may be the same or substantially the same as that of the second switch S2. When some of the sensing lines SL are connected to the second switch S2 whereas others are not, loads of the sensing lines SL connected to the second switch S2 and the others that are not connected to the second switch S2 become different, and thus an error results when sensing an electrical signal. By including the dummy switch DS, the sensing apparatus 200 according to another embodiment may generate the same or substantially the same load to each of the sensing lines SL, and sense electrical signals to calculate correct values.

As illustrated in FIG. 8, an end of the dummy switch DS may be connected to the sensing line SL, and the other end of the dummy switch DS may be floated. However, the present invention is not limited thereto.

Figure 9:
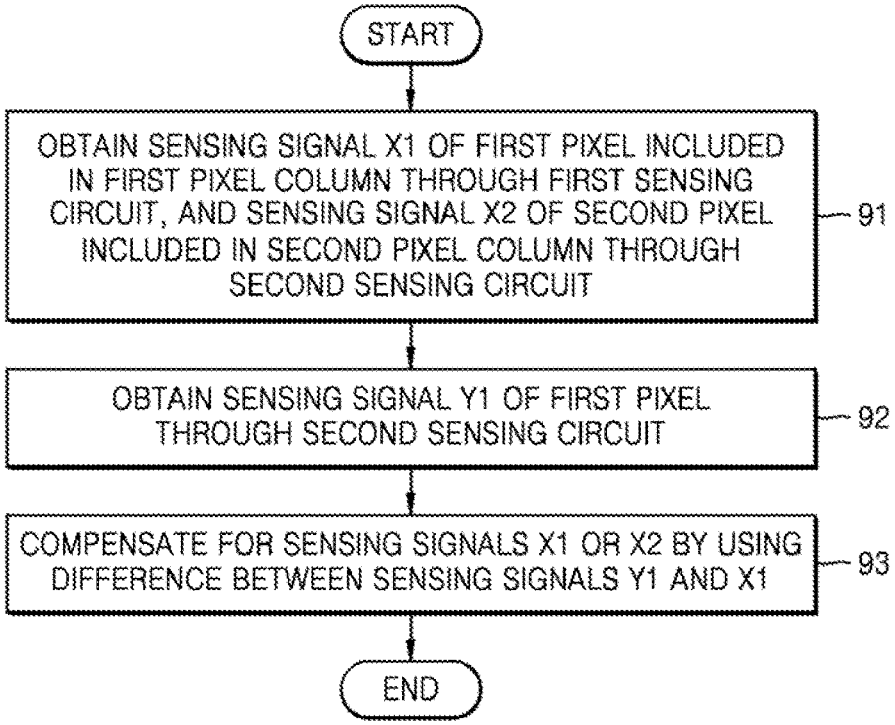
FIG. 9 is a flowchart showing how to obtain sensing data according to an embodiment of the present invention.

FIG. 9 is a flowchart showing how to obtain sensing data according to an embodiment.

Referring to FIG. 9, in operation 91, the sensing apparatus 200 obtains the sensing signal x1 of the first pixel included in the first pixel column by using the first sensing circuit, and obtains the sensing signal x2 of the second pixel included in the second pixel column by using the second sensing circuit adjacent to the first sensing circuit.

In operation 92, the sensing apparatus 200 obtains the sensing signal y1 of the first pixel by using the second sensing circuit.

In operation 93, the sensing apparatus 200 generates sensing data x'1 or x'2, which are compensated versions of the sensing signals x1 or x2, by referring to an error between the sensing signal y1 and the sensing signal x1.

Though not illustrated in FIG. 9, the sensing apparatus 200 may generate a parameter to compensate for the characteristic variation of the pixel PX by using the sensing data, and may store the parameter in a memory or output the parameter.

The sensing apparatus 200 according to an embodiment described above may be formed as an independent device that is spaced from the display panel 100, or may be formed as one body with the display panel 100 while being formed on the same substrate as the display panel 100. At least some of functions of the sensing data output unit 210 described above may be performed by a controller (not shown) that controls a display of the display panel 100. The sensing data output unit 210 may be driven according to controlling signals provided by the controller of the display panel 100.

The sensing data described in the aforementioned embodiment may be used to compensate image data by using the characteristic variation for each of the pixels PX. For example, when an identical image signal is applied to every pixel PX of the display panel 100 and the sensing data of every pixel PX are obtained, the difference between the sensing data may correspond to the characteristic variation of the pixel PX. The characteristic variation of the pixel PX may be caused by a characteristic variation of a transistor included in the pixel PX or caused by the difference in degrees of degradation of the pixels PX.

The display apparatus according to an embodiment may generate a parameter that compensates for a characteristic variation of each pixel PX by using sensing data, and compensate an image signal input to the display panel 100 by using the parameter. In this regard, a mura effect caused by the characteristic variation of each pixel PX may be reduced.

The obtaining of the sensing data according to an embodiment may be performed when an event (e.g., a preset event) in a display apparatus is detected or may be manually performed by a trigger of a user. The event may be, for example, an on/off state of the display apparatus, but the present invention is not limited thereto. When the sensing data is obtained, the sensing data may be stored in a memory of the display apparatus. A parameter that is obtained after processing the sensing data and compensates for a variation of each pixel PX may also be stored in the memory. The parameter may be used for a controller of the display apparatus to compensate an image signal and may be updated by the sensing apparatus 200 periodically or randomly.

In the embodiments described above, when calculating a characteristic variation between sensing circuits SC, a difference between values obtained when each of the two sensing circuits SC is used to measure the same electrical signal, for example, a subtraction calculation is used, but the present invention is not limited thereto. For example, a ratio of measurement values of the two sensing circuits SC with respect to the same electrical signal may be used to calculate the characteristic variation between the sensing circuits SC. Various suitable calculation methods may be used to define a characteristic variation between the sensing circuits SC.

The obtaining of the sensing data according to the afore-described embodiment may be implemented as an executable program, and may be executed by a general-purpose digital computer that runs the program by using a computer-readable recording medium. Examples of the computer-readable medium include storage media such as magnetic storage media (e.g., read only memories (ROMs), floppy discs, or hard discs), optically readable media (e.g., compact disk-read only memories (CD-ROMs), or digital versatile disks (DVDs)), etc.

As described above, according to the one or more of the above exemplary embodiments, a sensing apparatus, a display apparatus, and a method of sensing an electrical signal according to an embodiment obtains a characteristic variation of a sensing circuit that senses an electrical signal. The sensing apparatus, the display apparatus, and the method of sensing the electrical signal according to an embodiment obtains correct sensing data in which an error caused by the sensing circuit of the sensing circuit is removed.

It should be understood that exemplary embodiments described herein should be considered in a descriptive sense only and not for purposes of limitation. Descriptions of features or aspects within each exemplary embodiment should typically be considered as available for other similar features or aspects in other exemplary embodiments. While one or more exemplary embodiments have been described with reference to the figures, it will be understood by those of ordinary skill in the art that various changes in form and details may be made therein without departing from the spirit and scope as defined by the following claims, and their equivalents.

What is claimed is:

1. A sensing apparatus configured to sense electrical signals of a plurality of pixels arranged in rows and columns, the sensing apparatus comprising:

a plurality of sensing circuits configured to sense the electrical signals through sensing lines that respectively correspond to the columns of the pixels, the plurality of sensing circuits including:

a first sensing circuit that corresponds to a first pixel column of the columns of the pixels;

a second sensing circuit that corresponds to a second pixel column of the columns of the pixels and is different from the first sensing circuit; and a third sensing circuit that corresponds to a third pixel column of the columns of the pixels and is different from the first and the second sensing circuits;

a plurality of primary switches including:

a first primary switch configured to connect a first sensing line of the sensing lines that corresponds to the first pixel column with the first sensing circuit; and a second primary switch configured to connect a second sensing line of the sensing lines that corresponds to the second pixel column with the second sensing circuit; and a plurality of secondary switches including:

a first secondary switch configured to connect the first sensing line and a with the second sensing circuit; and a second secondary switch configured to connect the second sensing line with the third sensing circuit;

wherein an electrical signal transmitted to the second sensing circuit through the first secondary switch is same as an electrical signal transmitted to the first sensing circuit through the first primary switch.

2. The sensing apparatus of claim 1, wherein the second sensing circuit is adjacent to the first sensing circuit.

3. The sensing apparatus of claim 1, wherein the second pixel column is adjacent to the first pixel column.

4. The sensing apparatus of claim 1, wherein each of the plurality of sensing circuits comprises an analog-digital converter, and wherein the electrical signals are voltages of emission devices of the plurality of pixels.

5. The sensing apparatus of claim 1, wherein each of the plurality of sensing circuits comprises:

an integrator; and an analog-digital converter, and wherein the electrical signals are driving currents of emission devices of the plurality of pixels.

6. A display apparatus comprising:

a display panel comprising:

a plurality of pixels arranged in rows and columns; and sensing lines that correspond to the columns of the pixels, respectively, the sensing lines including:

a first sensing line that corresponds to a first pixel column of the columns of the pixels;

a second sensing line that corresponds to a second pixel column of the columns of the pixels; and a third sensing line that corresponds to a third pixel column of the columns of the pixels; and a sensing apparatus configured to sense electrical signals of the plurality of pixels, wherein the sensing apparatus comprises:

a plurality of sensing circuits configured to sense the electrical signals through the sensing lines, the plurality of sensing circuits including:

a first sensing circuit that corresponds to the first pixel column;

a second sensing circuit that corresponds to the second pixel column and is different from the first sensing circuit; and a third sensing circuit that corresponds to the third pixel column and is different from the first and the second sensing circuits;

a plurality of primary switches including:

a first primary switch configured to connect the first sensing line with the first sensing circuit; and a second primary switch configured to connect the second sensing line with the second sensing circuit; and a third primary switch configured to connect the third sensing line with the third sensing circuit; and a plurality of secondary switches including:

a first secondary switch configured to connect the first sensing line with the second sensing circuit; and a second secondary switch configured to connect the second sensing line with the third sensing circuit.

7. A method of sensing electrical signals of a plurality of pixels arranged in rows and columns by using the sensing apparatus of claim 1, the method comprising:

obtaining a sensing signal x1 by sensing an electrical signal of a first pixel of the pixels comprised in the first pixel column using the first sensing circuit;

obtaining a sensing signal y1 by sensing the electrical signal of the first pixel using the second sensing circuit; and calculating a characteristic variation d between the first sensing circuit and the second sensing circuit based on a difference between the sensing signals x1 and y1.

8. The method of claim 7, further comprising:

obtaining a sensing signal x2 by sensing an electrical signal of a second pixel of the pixels comprised in the second pixel column using the second sensing circuit, and compensating for the sensing signal x2 by using the characteristic variation d.

9. The method of claim 8, further comprising:

outputting the sensing signal x1 as sensing data for the first pixel; and outputting a compensated sensing signal x'2 as sensing data for the second pixel.

10. The method of claim 8, wherein the second pixel column is adjacent to the first pixel column, and wherein the second sensing circuit is adjacent to the first sensing circuit.

11. The method of claim 7, wherein in the obtaining of the sensing signal x1, the sensing signal x1 is obtained when the first primary switch is closed and the first secondary switch is opened, and wherein in the obtaining of the sensing signal y1, the sensing signal y1 is obtained when the first primary switch is opened and the first secondary switch is closed.

12. A sensing apparatus configured to sense electrical signals of a plurality of pixels arranged in rows and columns, the sensing apparatus comprising:

a plurality of sensing circuits configured to sense the electrical signals through sensing lines that respectively correspond to the columns of the pixels, the plurality of sensing circuits including:

a first sensing circuit that corresponds to first to $k_{th}$ pixel columns of the columns of the pixels;

a second sensing circuit that corresponds to $k+1_{th}$ to $2k_{th}$ pixel columns of the columns of the pixels and is different from the first sensing circuit; and a third sensing circuit that corresponds to $2k+1_{th}$ to $3k_{th}$ pixel columns of the columns of the pixels and is different from the first and the second sensing circuits;

a plurality of primary switches including:

first primary switches configured to respectively connect first to $k_{th}$ sensing lines of the sensing lines with the first sensing circuit; and second primary switches configured to respectively connect $k+1_{th}$ to $2k_{th}$ sensing lines of the sensing lines with the second sensing circuit; and a plurality of secondary switches including:

a first secondary switch configured to connect one of the first to $k_{th}$ sensing lines with the second sensing circuit; and a second secondary switch configured to connect one of the $k+1_{th}$ to $2k_{th}$ sensing lines with the third sensing circuit.

13. The sensing apparatus of claim 12, wherein the second sensing circuit is adjacent to the first sensing circuit.

14. The sensing apparatus of claim 12, further comprising:

first dummy switches connected to the others of the first to $k_{th}$ sensing lines; and second dummy switches connected to the others of the $k+1_{th}$ to $2k_{th}$ sensing lines.

15. The sensing apparatus of claim 14, wherein a load of each of the first dummy switches is the same as a load of the first secondary switch.

* * * * *